US012551765B2

(12) United States Patent
DeChambeau et al.

(10) Patent No.: US 12,551,765 B2
(45) Date of Patent: Feb. 17, 2026

(54) FITTING SYSTEM FOR A BULGE AND A ROLL ON ONE OR MORE GOLF CLUBS

(71) Applicant: LA Golf Partners LLC, Newport Beach, CA (US)

(72) Inventors: Bryson DeChambeau, Dallas, TX (US); Jeffrey William Meyer, Fallbrook, CA (US)

(73) Assignee: LA Golf Partners LLC, Newport Beach, CA (US)

( * ) Notice: Subject to any disclaimer, the term of this patent is extended or adjusted under 35 U.S.C. 154(b) by 0 days.

(21) Appl. No.: 19/060,451

(22) Filed: Feb. 21, 2025

(65) Prior Publication Data

US 2025/0262495 A1 Aug. 21, 2025

Related U.S. Application Data

(60) Provisional application No. 63/556,250, filed on Feb. 21, 2024.

(51) Int. Cl.

| | |
|---|---|
| ***A63B 60/42*** | (2015.01) |
| ***A63B 24/00*** | (2006.01) |
| ***A63B 53/04*** | (2015.01) |

(52) U.S. Cl.

CPC ..... *A63B 60/42* (2015.10); *A63B 24/0006* (2013.01); *A63B 53/042* (2020.08); *A63B 24/0003* (2013.01); *A63B 2024/0015* (2013.01); *A63B 53/0466* (2013.01); *A63B 2220/05* (2013.01); *A63B 2220/30* (2013.01); *A63B 2220/806* (2013.01)

(58) Field of Classification Search

CPC ..... A63B 24/0003; A63B 24/0006; A63B 2024/0015; A63B 60/46; A63B 60/42; A63B 2220/05; A63B 2220/30; A63B 2220/806

See application file for complete search history.

(56) References Cited

U.S. PATENT DOCUMENTS

| | | | | |
|---|---|---|---|---|
| 10,076,689 | B2 | 9/2018 | De La Cruz et al. | |
| 11,161,023 | B2 | 11/2021 | Frederickson et al. | |
| 11,731,011 | B2 | 8/2023 | Morales et al. | |
| 2010/0255927 | A1 | 10/2010 | Evans | |
| 2014/0051526 | A1* | 2/2014 | Johnson | G06V 40/23 473/409 |
| 2015/0328522 | A1* | 11/2015 | Murata | A63B 60/42 434/252 |
| 2018/0099188 | A9 | 4/2018 | Mitzel et al. | |

* cited by examiner

*Primary Examiner* — Christopher J. Besler

(74) *Attorney, Agent, or Firm* — Seyfarth Shaw LLP

(57) ABSTRACT

A method of for determining an amount of bulge and roll of a golf club striking plate that is optimal for a golfer, including, testing golf clubs having striking plates with various amounts of bulge and/or roll using a robotic swinging arm, gathering data obtained from the testing, measuring a swing characteristic for the golfer, and determining the optimum amount of bulge and/or roll to include in the striking plate for the golfer based on the golfer's swing characteristic.

14 Claims, 8 Drawing Sheets

FITTING SYSTEM FOR A BULGE AND A ROLL ON ONE OR MORE GOLF CLUBS

CROSS-REFERENCE TO RELATED APPLICATION

The present application claims the benefit of U.S. Provisional Patent Application No. 63/556,250 filed on Feb. 21, 2024, and titled "FITTING SYSTEM FOR VARYING A BULGE AND A ROLL ON ONE OR MORE GOLF CLUBS," the disclosure of which is expressly incorporated by reference in its entirety.

FIELD OF THE DISCLOSURE

Aspects of the present disclosure generally relate to golf clubs, and more particularly to a system for fitting a bulge and roll for one or more golf clubs based on one or more factors.

BACKGROUND

Golf attracts a diverse range of players, including different genders, ages, and skill levels. Its unique nature allows these varied groups to participate together in events and competitions. Using various equalizing factors, such as handicapped scoring and different tee boxes, golfers of varying abilities can enjoy and compete in the sport. This inclusivity, along with the growing availability of golf-related TV programming and the rise of famous golf personalities, has boosted golf's popularity globally.

Golf clubs are diversified into several types to cater to different aspects of the game. Woods, which were originally made of wood but are now mostly metal, are designed for long-distance shots. The driver, or 1-wood, has the lowest loft and is used off the tee for long fairways, while 3- and 5-woods are ideal for longer shots on the fairway. Irons, numbered from 1 to 9, are versatile for various shots, with lower-numbered irons used for longer distances and higher-numbered ones for shorter, high-lofted shots. Hybrids, a blend of woods and irons, have gained popularity for their ease of use, especially for long shots where woods are less manageable. Wedges, including the pitching, sand, gap, and lob wedges, are a special type of iron with higher lofts, perfect for short-distance shots, especially when approaching the green or escaping hazards like sand traps. Finally, putters, crucial on the green, are used to roll the ball into the hole.

Each club type is crafted to address specific needs, such as distance, precision, or navigating course challenges, such as sand traps and water hazards, and the composition of a golfer's bag often reflects their individual playing style and the typical courses they encounter.

In golf, a gear effect refers to how a golf ball reacts when struck off-center by a curved clubface, such as clubfaces found on drivers, fairway woods and hybrids. When the ball is hit toward the toe of the club, the ball tends to spin in a way that counteracts a slice, causing a shot that may start to the right but curves back to the left for a right-handed golfer. Conversely, hitting the ball toward the heel typically exacerbates slice spin, leading to a more pronounced curve to the right. Additionally, the gear effect has a vertical component. Striking the ball above or below the center of the clubface can alter the launch angle and spin, with hits below the center adding backspin and those above reducing it. This effect plays a significant role in the distance and accuracy of a golf shot. Golfers may improve their hitting accuracy and distance control by understanding and managing the vertical and horizontal gear effect.

SUMMARY

The present disclosure relates to aspects of selecting a golf club to suit a golfer having particular swing characteristics, in particular by providing the appropriate bulge and roll curvature of a striking plate of the golf club head. The striking plate includes bulge and roll, using the radius of a circle to describe the respective curves. The bulge and roll are selected to counteract the gear effect to provided the desired spin characteristics for off-center hits. Different players generate different speeds when they swing, which affects how the ball compresses against the clubface and subsequently how it launches. By optimizing these design elements, you can tailor the club to work more efficiently for different speeds. The method for determining an amount of bulge and roll of a golf club striking plate that is optimal for a golfer includes, testing golf clubs having striking plates with various amounts of bulge and/or roll using a robotic swinging arm, gathering data obtained from the testing, measuring a swing characteristic for the golfer, and determining the optimum amount of bulge and/or roll to include in the striking plate for the golfer based on the golfer's swing characteristic.

The present disclosure also provides for selecting additional golf club characteristics based on a golfer's swing characteristic(s). For example, depending on the swing speed or skill level of the golfer, the moment of inertia, center of gravity, and surface treatment of the striking plate may be varied to be optimized for a golfer's swing speed and/or skill level.

BRIEF DESCRIPTION OF THE DRAWINGS

So that the above-recited features of the present disclosure can be understood in detail, a more particular description, briefly summarized above, may be had by reference to aspects, some of which are illustrated in the appended drawings. It is to be noted, however, that the appended drawings illustrate only certain typical aspects of this disclosure and are therefore not to be considered limiting of its scope, for the description may admit to other equally effective aspects. The same reference numbers in different drawings may identify the same or similar elements.

DETAILED DESCRIPTION

Figure 1:
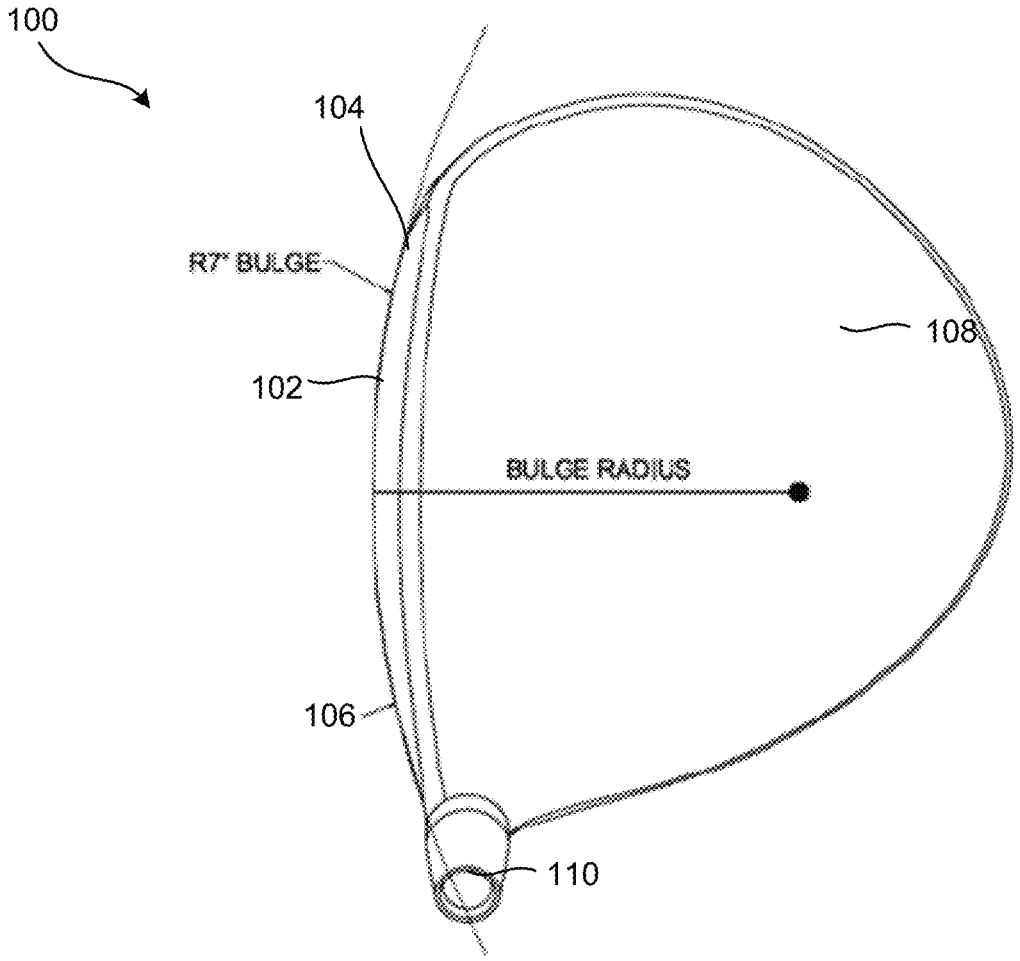
FIG. 1 illustrates an example of a top-down view of a clubface, in accordance with various aspects of the present disclosure.

Various aspects of the disclosure are described more fully below with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings, one skilled in the art should appreciate that the scope of the disclosure is intended to cover any aspect of the disclosure disclosed, whether implemented independently of or combined with any other aspect of the disclosure. For example, an apparatus may be implemented or a method may be practiced using any number of the aspects set forth. In addition, the scope of the disclosure is intended to cover such an apparatus or method, which is practiced using other structure, functionality, or structure and functionality in addition to or other than the various aspects of the disclosure set forth. It should be understood that any aspect of the disclosure disclosed may be embodied by one or more elements of a claim.

As discussed, golf has increased in popularity on a global scale. Players across all skill levels strive to enhance their performance and lower their scores. Golf equipment manufacturers have responded to this demand by introducing various advancements and changes. For instance, a wide array of golf balls have been tailored to specific player needs. These balls include, for example, balls for different swing speeds, balls for longer or straighter flight, and balls offering better control or spin. Additionally, various swing aids and teaching tools are available to help players improve their scores.

Golf clubs have also seen considerable technological development. Recent years have brought various innovations in putters, club heads, shafts, and grips. Moreover, technologies have been developed to align golf club features and golf ball characteristics more closely with individual player swings, such as club fitting technology and ball launch angle measurement.

Despite these advancements in golf equipment, some players still face challenges in consistently hitting the ball in the desired direction or achieving the intended flight path.

Most conventional golf club heads, such as a head of a driver, are not flat. Instead, the head features a complex, curved geometry. This curve is characterized by two elements: roll and bulge. The roll refers to the vertical curvature of the driver's face, going from the top to the bottom. The bulge represents the horizontal curvature, extending from one side to the other.

The dimensions of golf club faces, particularly drivers and fairways, are often measured and described in terms of their radius, which is expressed in inches. A common specification for these modern drivers is a bulge and roll of 11 to 13.5 inches. For example, the curved striking face is provided so that a ball struck in the toe area will begin its flight path to the right of target, and the hook spin imparted on the ball by the gear effect will curve the ball back toward the target line (for a right-handed golfer).

FIG. 1 is a diagram illustrating a golf club head 100 having a 7 inch bulge. The golf club head 100 includes a striking plate 102 (also referred to as the clubface), having a toe 104 and a heel 106. The club head 100 includes a crown 108, and hosel 110 configured to receive a golf club shaft. The golf club head 100 includes a sole 112, shown in FIG. 5. The crown 108 and sole 112 may be referred to collectively as the golf club head body. The sole 112 and crown 108 define a body behind the striking plate 102. It would be appreciated that various dimensions of the sole 112 and crown 108 may be provided to produce a driver head with the desired appearance and weight distribution properties.

The example of FIG. 1 illustrates an example of a 7" bulge radius. Aspects of the present disclosure are not limited to the 7" bulge radius, different levels of curvature, such as, but not limited to, 10" radius, 9" radius, 8" radius, 7" radius, and 6" radius are contemplated.

Figure 2:
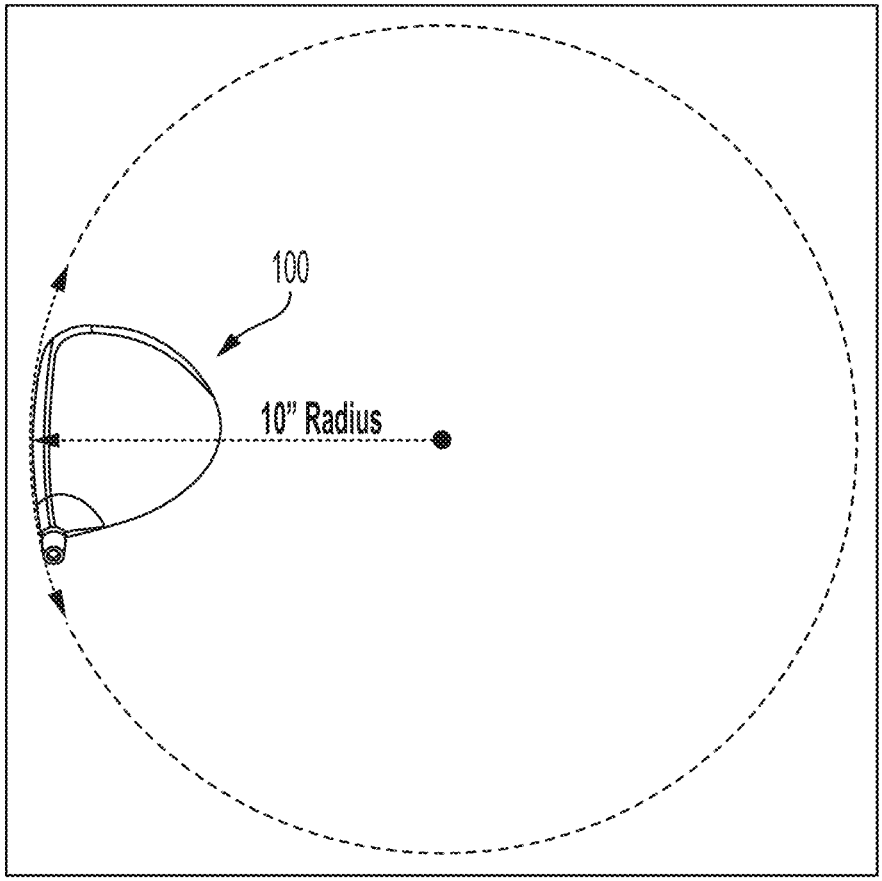
FIG. 2 is a diagram illustrating an example of a 10 inch bulge, in accordance with various aspects of the present disclosure.

FIG. 2 is a diagram illustrating an example of a 10 inch bulge for a golf club head 100. As shown in FIG. 2, a circle with a diameter of 20 inches has a radius of 10 inches. The curvature of this circle's arc is used as a reference for shaping the club face from the heel 106 to the toe 104 and from the sole 112 to the crown 108. While not shown, a golf club may also have a wood, hybrid or iron configuration, as such configurations are well known in the art.

For a larger radius, such as 12 inches, the resulting face of the club would be flatter. This is because a larger circle (24 inches in diameter in this case) has a gentler curve. In contrast, the smaller the radius number, the more pronounced the curvature of the club face.

This curvature impacts how the club interacts with the ball, influencing various factors, such as the direction and flight of the ball. A more curved face (smaller radius) will have different impact characteristics compared to a flatter face (larger radius), and these characteristics are vital for golfers to consider when selecting their clubs based on their playing style and the type of shots they commonly play.

When hitting a ball using a golf club, such as a driver, hitting a sweet spot on the golf club makes it possible to maximize reaction force, increase the driving distance, maintain a correct direction, and reduce shock and vibration. The sweet spot is a point on the clubface of a golf club that transmits the most energy to the ball. A failure to accurately hit the sweet spot may cause the ball to be hit on the top or bottom side of the face, including the heel and toe areas of the face. Striking the ball with the toe or heel areas may cause hook spin or slice spin, resulting in the shot going off the target line, and likely penalizing the golfer, as the ball may land in a hazard or the rough area of the golf course. Striking the ball above or below the center of the face (also referred to as the sweet spot) may lead to a loss of driving distance, which affects the second shot and the third shot, thus making it difficult for a player to get a good score.

Over time, golf swing speed has increased. For example, when a professional golfer, such as Bryson DeChambeau, strikes the ball with a high golf swing speed, the compression of the ball is greater than what is typically observed. This increased compression results in an increased surface area making contact with the striking face. This increased contact area between the striking plate and the ball results in an increased gear effect, as the rotation of the club head leads to unacceptably high spin rates imparted to the golf ball.

Consequently, if a golfer's (e.g., DeChambeau) shot is slightly off-center—be it towards the heel or toe of the club face—the club striking face will rotate, as the center of mass of the ball will not run through the center mass of the club head, along the line to the target. The rotation of the club face will result in lost distance, and the increased contact area leads to a high side spin rate that will result in the ball traveling to the right or left of the target line. Similarly, if the golfer hits the ball either too high or low on the club face, the ball ends up with unacceptably high spin rates.

Various aspects of the present disclosure are directed to optimizing the bulge and the roll of a clubface to (improve the horizontal and vertical gear effect). Such aspects may particularly benefit players with higher swing speeds, as their misses are exaggerated due to their higher club head speeds. Additionally, in some examples, a bulge and roll radius may be customized based on club head speed and/or ball speed. Customizing the bulge and roll may improve both accuracy and spin.

Figure 3A:
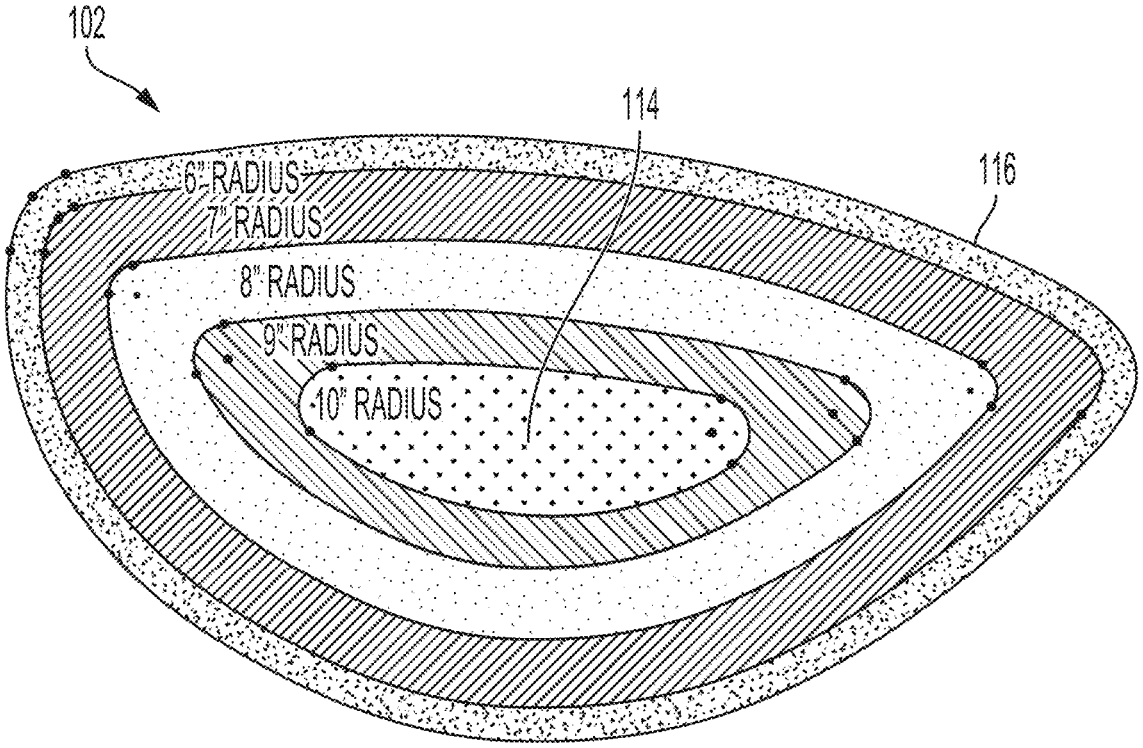
FIG. 3A is a diagram illustrating an example of a non-conventional clubface in accordance with the various aspects of the present disclosure.
Figure 3B:
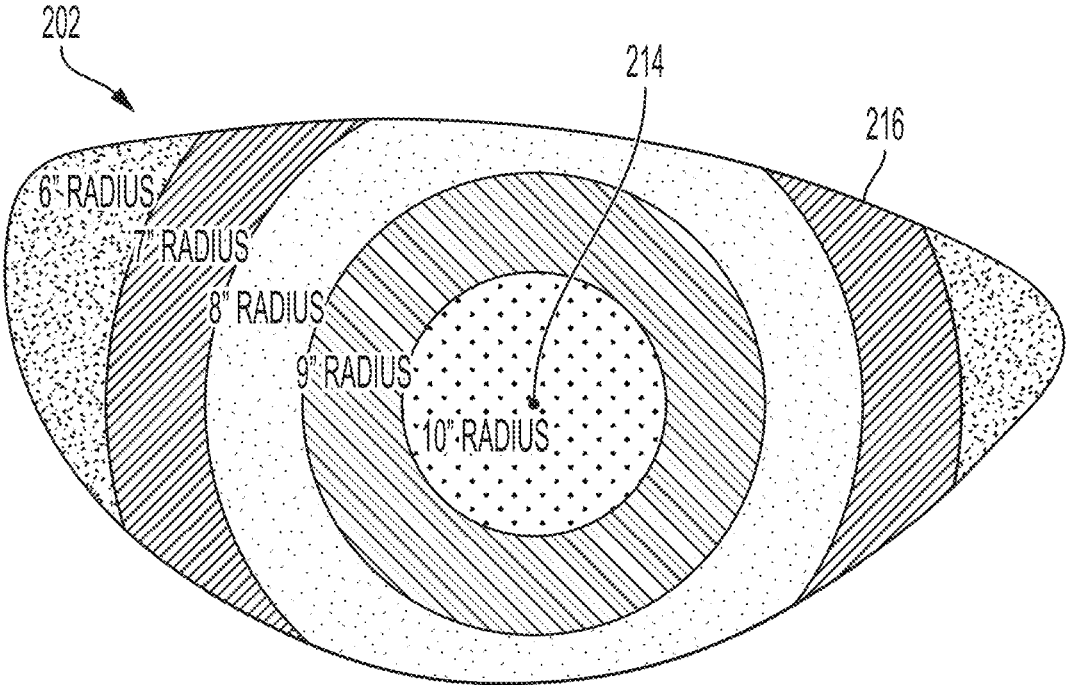
FIG. 3B is a diagram illustrating an example of a striking plate having concentric circles of various bulge and roll radii, in accordance with various aspects of the present disclosure.

FIG. 3A is a diagram illustrating an example of a conventional striking plate 102. In the example of FIG. 3, a curve of the club face is characterized by a roll and bulge. As discussed, the roll refers to the vertical curvature of the driver's face, going from the top to the bottom. Additionally, the bulge represents the horizontal curvature, extending from the heel to the toe of the golf club. In the example of FIG. 3, different curvatures of the roll and bulge are visualized through concentric, irregular circles on the face of the club (e.g., driver), each indicating different levels of curvature, such as 10" radius, 9" radius, 8" radius, 7" radius, and 6" radius. Each radius represents a radius of a curvature. The striking plate 102 includes a center 114 and a perimeter area 116. FIG. 3B is a diagram illustrating another example of a striking plate 202 having a center area 214 and a perimeter area 216. In FIG. 3B the center 214 is a circular center, where the bulge and roll are each a 10 inch radius, and this circular center has the same curve. It would be appreciated that the relative sizes of the center area and perimeter area are not limited, and the labels in FIGS. 3A and 3B are for illustrative purposes only.

As discussed, various aspects of the present disclosure are directed to customizing the bulge and the roll of the clubface to match a player's swing speed. This customization may particularly benefit players with higher swing speeds, as clubs with a flatter striking plate may result in too much spin in either a horizontal or vertical aspect.

Different players generate different speeds when they swing, which affects how the ball compresses against the clubface and, subsequently, how it launches. Therefore, aspects of the present disclosure are not limited to a one-size-fits-all solution. In some examples, the clubface may be customized based on different player profiles. For example, if a player tends to have a swing flaw that leads to hitting the ball more on the heel, the clubface can be manufactured with a larger sweet spot specifically designed for that region. This level of customization allows for a broad range of players to benefit from different bulge and roll curvatures.

Thus, in some examples, a fitting system is specified for one or more golf clubs where the bulge and roll of each clubface may vary based on club head speed and/or ball speed. For example, a golfer's club head speed and/or ball speed may be measured, and appropriate clubfaces may be specified for the golfer. In some such examples, there may be a progression in the bulge and roll from the driver through the wedges. As an example, for a golfer with 190 mph driver ball speed, a bulge and roll of around 7.00" may be specified for the driver, and 0.00" may be specified for a lob wedge, as well as more bulge and roll for the 4 iron than the 9 iron.

To generate data relating to bulge and roll, a mechanical testing robot may be used to test various golf clubs at various club head speeds. The effects of bulge and roll of a golf club may also be tested by striking the ball with impacts located center, heel, toe, high and low on the striking plate. Other aspects of the robot swing may also be measured to mimic swing characteristics that a human golfer would have such as the vertical swing plane and horizontal swing plane angles. Sensors may be used to measure the golf ball flight during testing, including spin axis tilt, side spin, back spin, speed, trajectory, etc. This data may be used to determine the best amount of bulge and roll for a golfer with a certain club head speed. The data may also be used to determine the bulge and roll for a driver, as well as the bulge and roll to be provided in other golf clubs such as woods, hybrids, and irons. In addition to club head speed, other swing characteristics of a golfer may also be considered in determining the bulge and roll to provide in each of the golf clubs in a set of golf clubs for that particular golfer. Swing characteristics such as swing plane, the path of the golfer's hands, and positional measurements of a golfer's torso, arms, hands, etc., may also be measured for a golfer, and these swing characteristics may also be used to determine the amount of bulge an roll to be provided in the striking face of golf clubs.

To achieve precise and repeatable testing conditions, aspects of the present disclosure use a robotic swinging arm to conduct controlled evaluations of various golf clubs at different club head speeds. The robotic device ensures that each test is executed with exact repeatability, removing inconsistencies introduced by human variability, such as fluctuations in swing mechanics, fatigue, or slight alterations in impact conditions. By systematically controlling the club head speed and impact position, the robotic system enables an accurate assessment of how different bulge and roll radii influence ball flight characteristics, including launch angle, side spin, backspin, and overall trajectory. Examples of test data are provided in Tables 1 and 2.

The robotic system is programmed to replicate multiple swing conditions, including variations in attack angle, impact location, and follow-through path. Sensors embedded within the system capture precise measurements of ball flight dynamics, including initial velocity, spin axis tilt, and dispersion. The data generated from these tests is fed into an analytical engine that determines optimal bulge and roll configurations tailored to different club head speeds. Unlike human testing, which can never achieve perfect consistency, the robotic system ensures every test is conducted under identical conditions, allowing for precise comparison of various club configurations. Furthermore, the robotic system can execute thousands of test swings without degradation in performance, significantly improving the depth and reliability of the gathered data.

In addition to direct robotic testing, as further discussed below, the system incorporates advanced biomechanical measurements to enhance golf club fitting. Motion capture technologies, inertial measurement units (IMUs), and high-speed cameras track a golfer's swing mechanics in real-time, capturing essential kinematic data such as club head speed, hand path, wrist rotation, weight transfer, and overall swing dynamics. These biomechanical factors directly impact how a golfer interacts with the club, influencing the required bulge and roll characteristics to optimize their performance. By correlating biomechanical data with robotic test results, the system provides a comprehensive understanding of how individual swing styles interact with different club face geometries.

In some examples, machine learning models are employed to refine and optimize the bulge and roll fitting process. By training on extensive data sets derived from robotic testing and biomechanical analysis, the system can predict the ideal bulge and roll configuration for a golfer without requiring exhaustive testing of every possible variation. For example, based on a limited set of robotic swings, the machine learning model may predict patterns in ball response and impact behavior, enabling the system to recommend additional club face configurations that may enhance performance. Similarly, given a set of biomechanical inputs from a golfer's swing, the system can infer the optimal club face geometry that would maximize accuracy and distance for that specific player. This predictive capability significantly reduces the need for exhaustive physical testing, allowing for a streamlined and efficient fitting process.

In some examples, the system is designed for full automation, ensuring that once the ideal club configuration is determined, the data can be transmitted to a manufacturing facility for autonomous club customization. Upon finalizing a golfer's optimal bulge and roll parameters, the system generates precise manufacturing specifications, which are then transmitted to a club manufacturing facility via an integrated digital interface. At the facility, automated machining and assembly processes construct the club to exact specifications, ensuring that the club face curvature, material composition, and structural properties match the prescribed design. This eliminates manual fitting adjustments and ensures that each club is manufactured to match a golfer's individualized performance needs.

Beyond the manufacturing process, automation extends to real-time club selection on the golf course. A robotic caddy, equipped with artificial intelligence and integrated swing-tracking sensors, can autonomously select the appropriate golf club for a player based on real-time swing data and course conditions. By continuously monitoring a golfer's biomechanics and environmental factors, such as wind speed and terrain, the robotic caddy dynamically recommends the optimal club for each shot. The robotic caddy can also analyze past performance trends and suggest strategic adjustments based on historical data, further enhancing a golfer's consistency and overall gameplay.

The Trackman data clearing shows how various bulge and roll radii at various swing speeds can dramatically influence horizontal and vertical spin rates. Based on this test data, a new and novel way to fit golfers was created. Typically, golf fittings consist of fitting players for a driver by optimizing launch and spin rates by changing the club head loft, center of gravity, and/or shaft. This common process of fitting only takes into consideration impacts on the center of the clubface. A portion of test data is shown in Table 1 and 2, comparing the TaylorMade® 8° Stealth2 Plus driver head to a prototype driver ("BD Gamer"). As shown below, at a club head speed of about 113 mph, the TaylorMade® driver had higher spin rates than the BD Gamer. However, at the higher club head speed of about 124 mph, the spin rate of the TaylorMade® driver is significantly greater than the BD Gamer spin rate. The test data provided in Tables 1 and 2 was carried out using a robotic swing arm at Golf Laboratories, Inc. The swing robot is able to precisely position the striking plate relative to the ball to measure off-center hits, and it is able to provide a set amount of club head speed in order to accurately measure and compare the resulting ball flight from golf clubs having differing amounts of bulge and roll. The use of a robotic swing arm is necessary to obtain the testing data, as even the best golfers cannot replicate the exact same swing, club head position, and club head speed.

TABLE 1

| ¾" toe hits | | | | |
|---|---|---|---|---|
| Club | Club speed average | Side spin | Back spin | Spin rate |
| TaylorMade 8° Stealth2 Plus (shaft: tour AD 65 S) | 113.2 | 149.0 | 2435.0 | 2437.0 |
| BD Gamer 6° Formula Fire (shaft: LA golf proto) | 113.6 | 55.0 | 2182.7 | 2184.0 |
| TaylorMade 8° Stealth2 Plus (shaft: tour AD 65 S) | 123.7 | −492.7 | 2990.3 | 3030.7 |
| BD Gamer 6° Formula Fire (shaft: LA golf proto) | 124.0 | 48.3 | 2342.3 | 2377.7 |

TABLE 2

| ¾" heel hits | | | | |
|---|---|---|---|---|
| TaylorMade 8° Stealth2 Plus (shaft: tour AD 65 S) | 112.7 | 360.5 | 2470.0 | 2498.5 |
| BD Gamer 6° Formula Fire (shaft: LA golf proto) | 113.5 | −107 | 2172.7 | 2176.3 |
| TaylorMade 8° Stealth2 Plus (shaft: tour AD 65 S) | 123.8 | −273.3 | 2955.7 | 2972.7 |
| BD Gamer 6° Formula Fire (shaft: LA golf proto) | 124.2 | −267.3 | 2362.7 | 2377.7 |

As a non-limiting example, an estimated bulge and roll, based on club head speed may be specified as shown in Table 3 below.

TABLE 3

| driver club head speed and driver bulge/roll | |
|---|---|
| Driver Club Head Speed | Bulge/Roll |
| 135+ mph | 8.00"/7.00" |
| 125 to 135 mph | 9.00"/9.00" |
| 110 to 125 mph | 10.00"/10.00" |
| 90 to 110 mph | 12.00"/11.00" |
| 90 and below mph | 13.00"/12.00" |

Based on the examples above, a 10.00" bulge and roll radius for a golfer with a 110 to 125 mph club head speed may be tailored to provide more optimal horizontal and gear effect on off-center impacts. Conversely, a 9.00" bulge and roll radius could be more optimal for a golfer with a 125 to 135 mph club head speed, offering a similar kind of performance advantage. Table 3 provides the desired bulge and roll radii of a striking plate of a driver, but it would be understood that the drive club head speed may be used to determine the appropriate bulge and roll for other club types as well.

To determine the bulge and roll that is optimal for a golfer, the golfer's club head speed may be measured. Additional aspects of a golfer's swing may also be measured, which may be used to determine the optimal bulge and roll radius. Such measurements may be done by specialized cameras and equipment at a golf store to measure the ball flight and spin characteristics. The specialized equipment may also be used to measure a golfer's club head speed from several swings, and the club head speeds may be averaged together. To obtain more precise swing characteristics, sensors may be attached to the golfer to create a model of the bio-mechanical movements of the golfer and/or the club. Data regarding swing characteristics may also be made using a video recorded of the golfer swinging a golf club. The generation of a 3D avatar from 2D images of a user's movement is described in U.S. Pat. No. 12,008,839, incorporated by reference herein. The golfer may repeat their swing several times, and the properties of these swings may be combined to generate swing characteristics for the golfer. Swing characteristics may be determined by analyzing a user's movement (e.g., hand speed, hand path at key phases of a swing), along with other factors, such as height, wing span, torso length, etc., The video may also provide information about the club movement and ball movement after it has been struck by the club to further determine swing characteristics of the golfer.

Figure 4:
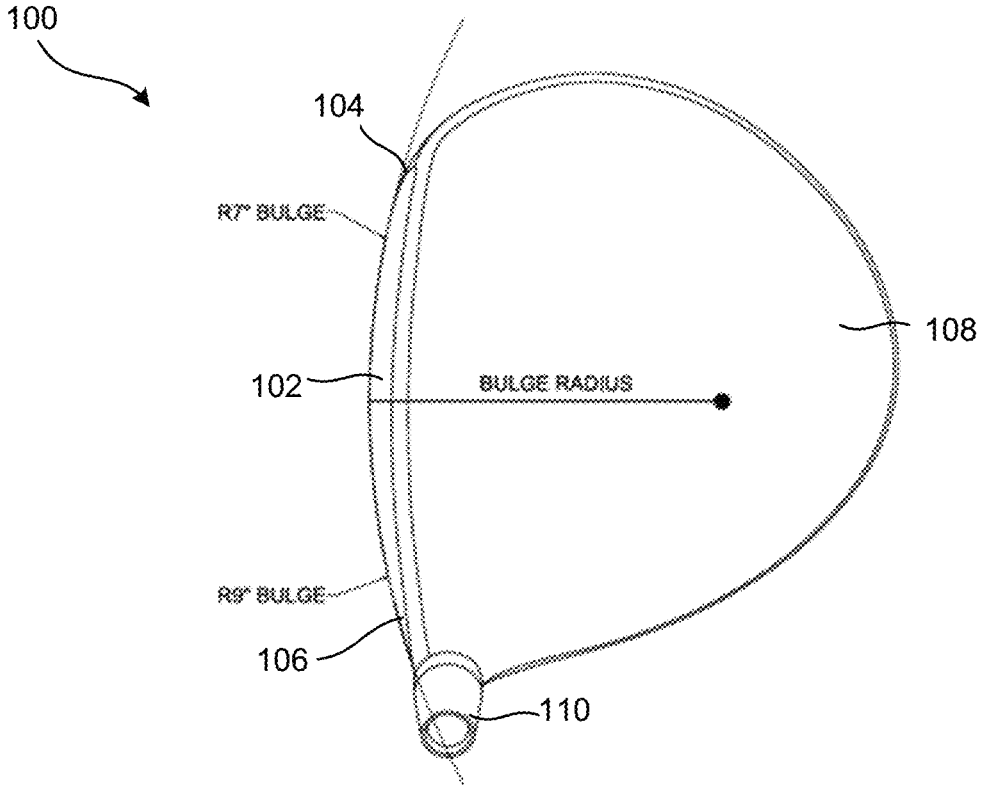
FIG. 4 illustrates an example of a top-down view of a clubface, in accordance with various aspects of the present disclosure.

In some examples, in addition to customizing the bulge and roll, a different bulge may be specified in a heel of a club in comparison to a toe of the club due to the center of gravity location, moment of inertia and coefficient of restitution of the club head design. FIG. 4 is a diagram illustrating an example of a top-down view of a clubface, in accordance with various aspects of the present disclosure. The example of FIG. 4 illustrates an example of a 7" bulge radius at the toe of the club and a 9" bulge radius at the heel of the club. The example of FIG. 4 is not to scale and is used for illustrative purposes. Aspects of the present disclosure are not limited to the 7" bulge radius at the toe and a 9" radius at the heel, different levels of curvature are contemplated.

Figure 5:
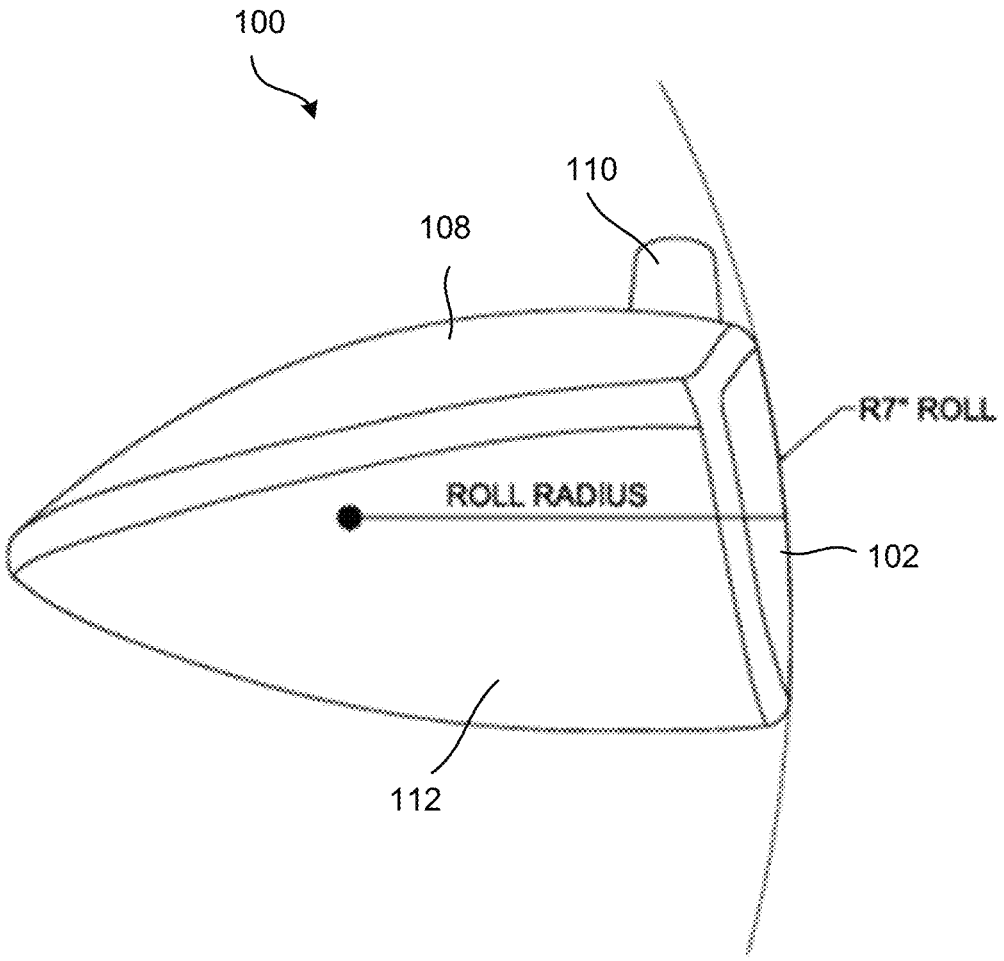
FIG. 5 illustrates an example of a side view of a clubface, in accordance with various aspects of the present disclosure.

FIG. 5 is a diagram illustrating an example of a side view of a clubface, in accordance with various aspects of the present disclosure. The example of FIG. 5 illustrates an example of a 7" roll radius. Aspects of the present disclosure are not limited to the 7" roll radius, different levels of curvature, such as, but not limited to, 10" radius, 9" radius, 8" radius, 7" radius, and 6" radius are contemplated.

The Moment of Inertia (MOI) is a measure of an object's resistance to rotational motion about a particular axis. For golf clubs, a higher MOI means the club will be more stable at impact, helping to reduce twisting for off-center hits. Customizing the MOI to match a player's club head speed could improve both distance and accuracy. For instance, a higher MOI might be advantageous for a beginner or someone with a slower swing speed, offering more forgiveness. On the other hand, a lower MOI might be suited for more experienced players who generate higher speeds and seek more control over ball spin. The swing characteristics of a golfer may be used to best determine the appropriate moment of inertia, in addition to questions about the golfer's desired style of play and sophistication.

The position of the club head center of gravity may similarly be selected based on the golfer's swing characteristics and preferred style of play. A center of gravity that is farther from the striking plate of a golf club may reduce the rotation of the club head caused by off-center ball strikes, which may reduce the gear effect.

In some examples, a moment of inertia and center of gravity for a club, such as a driver, wood, or hybrid, can be adjusted prior to connecting the face of the club to the aft of the club, thus leaving the exterior of the club head smooth and without moveable weights, slides or weight screws. In some such examples, the face may also have varying coefficients of restitution (both USGA conforming and USGA non-conforming), which can be interchanged. The face can be connected mechanically as well as with magnets.

In some examples, a clubface may have variable roughness. In such examples, the clubface may be smooth in the center (lower friction coefficient), with an increasing degree of roughness (higher friction coefficient) as you move toward the perimeter. A smoother center could reduce friction for those shots hit dead-center, potentially maximizing distance. A rougher perimeter could add spin to off-center hits, aiding in shot correction. This blend of characteristics could offer a player both distance and forgiveness, optimizing performance across a range of skill levels and shot qualities.

In some examples, a club may be produced with a forged faced cup, with a 100% composite section, or forged carbon. In such examples, a forged face is coupled with a composite body. The forging process generally produces a stronger, more consistent material, while the composite body allows for precise control over weight distribution. It would be appreciated that other manufacturing methods may also be used to manufacture golf clubs having the desired bulge and roll curvatures. Such techniques include (1) casting the golf club head body from titanium and weld the striking plate to it, and (2) different pieces of the club head are stamped out and welded together.

In some examples, a clubface may be magnetically coupled to a head, such that the clubface may be swappable with other clubfaces.

As discussed, various aspects of the present disclosure are directed to gathering data to determine the optimal bulge and roll radii for a golfer. In some examples, a multi-layered approach integrates high-precision motion tracking, sensor fusion, and predictive modeling. This process begins with robotic club testing, where a robotic swinging arm is programmed to execute precise and repeatable swings under controlled conditions. The robot is configured to strike the golf ball at various club head speeds and impact positions, including center strikes, heel strikes, toe strikes, high-face impacts, and low-face impacts. Each impact is recorded with high-speed cameras operating at thousands of frames per second to capture the moment of impact and the subsequent ball flight. Doppler radar systems, such as TrackMan or FlightScope, measure launch conditions, including ball speed, launch angle, spin rate, spin axis tilt, and carry distance. Infrared-based motion capture systems track the club's movement from backswing to follow-through, ensuring precise replication of swing mechanics across multiple test iterations.

In addition to visual and radar-based tracking, force sensors embedded in the robotic arm measure the exact forces exerted on the club head at the moment of impact. Strain gauges positioned within the club shaft provide real-time feedback on shaft deflection and torsional resistance. These data points help refine the correlation between the bulge and roll radii and the resulting ball flight characteristics, ensuring that each test provides meaningful insights into how different club face curvatures influence shot dispersion and spin dynamics. By systematically varying bulge and roll across multiple club head speeds, the system generates a comprehensive dataset that maps impact location, ball launch conditions, and shot accuracy against specific club face geometries. This dataset serves as the foundation for determining which club face curvature minimizes side spin, maximizes launch efficiency, and optimizes off-center impact correction.

Beyond robotic testing, the system integrates biomechanical golfer analysis to tailor the club specifications to an individual player's unique swing characteristics. High-speed motion capture cameras, such as those using marker-based optical tracking, record the golfer's movements throughout the swing sequence. Inertial measurement units (IMUs)

affixed to key body segments, including the wrists, elbows, shoulders, torso, and hips, provide continuous tracking of angular velocity, acceleration, and joint articulation. These IMUs, combined with ground force reaction plates positioned under the golfer's feet, allow for the measurement of weight transfer and balance throughout the swing. Electromyography (EMG) sensors may also be used to track muscle activation patterns, ensuring that the golfer's kinetic chain is analyzed for efficiency and consistency.

To further enhance precision, LiDAR-based depth sensors create a three-dimensional model of the golfer's posture and movement dynamics. By processing these 3D motion data points, the system generates a full kinematic profile of the golfer's swing, which is then compared against the results obtained from robotic testing. The golfer's club head speed, swing tempo, transition sequence, and release mechanics are all factored into the analysis. In some examples, machine learning models extrapolate from these measured data points to predict how a golfer would interact with club faces that have not been physically tested. By inputting a golfer's swing characteristics into a trained machine learning model (e.g., neural network), the model can predict the ideal bulge and roll curvature needed to optimize launch conditions without requiring exhaustive manual testing for every possible club configuration.

Once the optimal bulge and roll values are determined, the system can fully automate the customization process by transmitting the golfer's unique specifications directly to a manufacturing facility. Through a digital interface, the selected club specifications are sent to computer numerical control (CNC) milling machines and robotic assembly lines, where the club face is precisely machined to the prescribed curvature. Laser etching technology may be used to ensure that the final club head dimensions meet exact tolerances. In some examples, additional customization, such as weight distribution adjustments or face texture modifications, can be incorporated into the final product. The entire manufacturing workflow operates autonomously, removing human error from the customization process and ensuring that each club is manufactured with a level of precision that cannot be achieved manually.

In some examples, automation extends beyond club fitting and manufacturing to real-time club selection on the golf course. A robotic caddy equipped with an AI-driven decision engine can autonomously select the optimal golf club for a player based on real-time swing data and environmental conditions. By continuously monitoring the golfer's biomechanics, the robotic caddy can suggest adjustments to club selection based on fatigue levels, course layout, wind conditions, and historical shot patterns. The robotic caddy may also integrate with augmented reality (AR) systems, allowing the golfer to visualize projected ball flight paths before making a shot. By combining biomechanical analysis, robotic club testing, machine learning predictions, and automated club manufacturing, this system creates a highly advanced and data-driven approach to optimizing golf equipment for every individual player.

Figure 6:
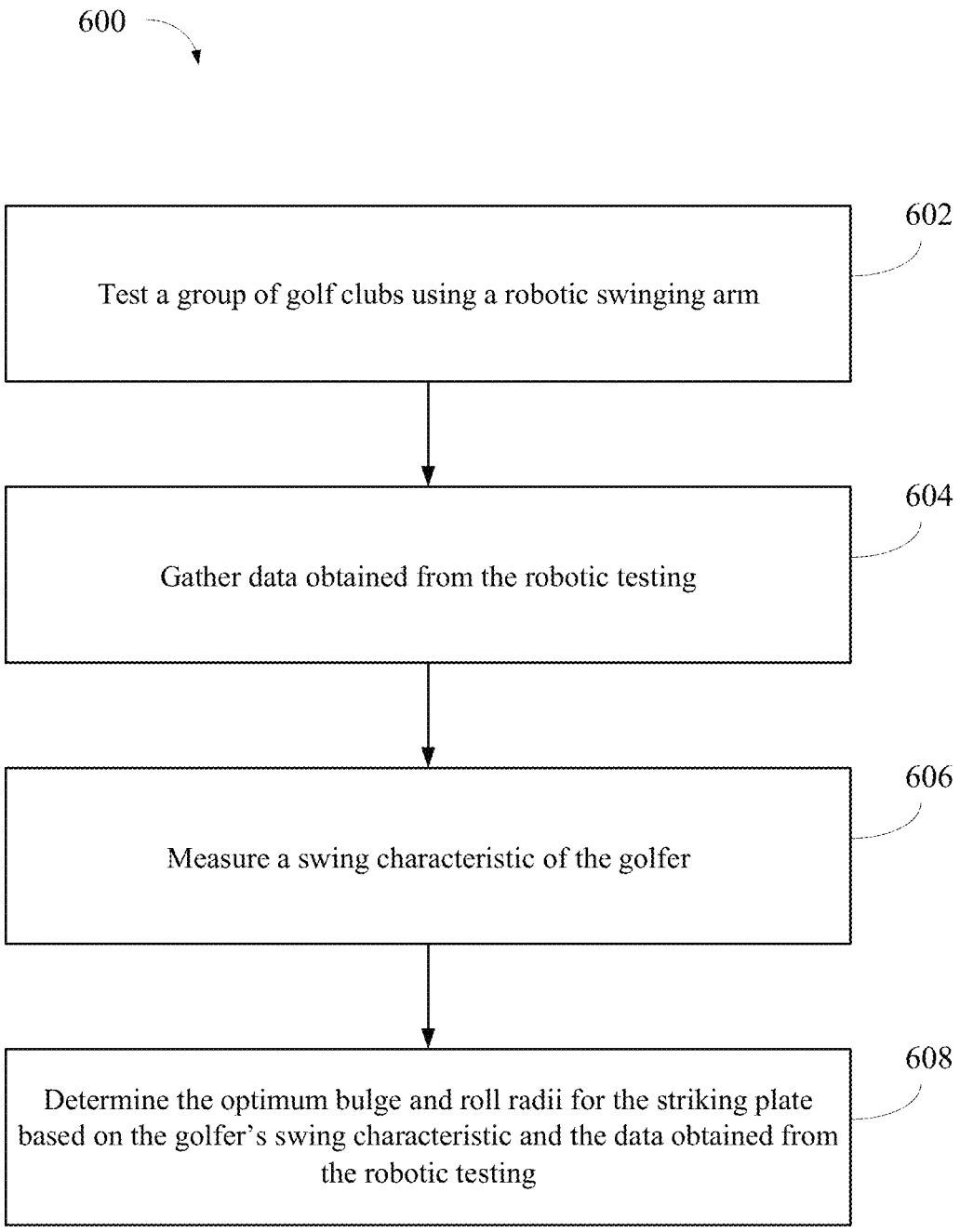
FIG. 6 is a flow diagram illustrating an example process for fitting a golfer for a set of golf clubs by determining the appropriate bulge and roll in the striking plates of the golf clubs, in accordance with various aspects of the present disclosure.

FIG. 6 is a flow diagram illustrating an example process 600 for fitting a golfer for a set of golf clubs by determining the appropriate bulge and roll in the striking plates of the golf clubs, in accordance with various aspects of the present disclosure. The process 600 begins at block 602 by testing a group of golf clubs using a robotic swinging arm. Each golf club in the group is designed with different bulge and/or roll radii, such that the system may systematically assess how variations in curvature impact ball flight characteristics. The robotic swinging arm may be programmed to execute controlled swings under consistent conditions, ensuring that each test swing is performed with the same club head speed, attack angle, and impact location. Sensors embedded in the robotic system capture detailed data from each test, including launch conditions, spin rates, impact dispersion, and energy transfer efficiency.

At block 604, the process 600 gathers data obtained from the robotic testing. This data may include, but is not limited to, high-speed cameras, Doppler radar systems, and infrared motion capture devices record critical metrics such as ball speed, launch angle, spin axis tilt, side spin, backspin, and/or carry distance. Additional force sensors positioned within the club shaft measure torsional deflection, while strain gauges capture impact force distribution. The system repeats the testing process across multiple club head speeds and impact positions to build a comprehensive dataset that maps the relationships between bulge and roll curvatures and shot performance outcomes. This dataset is stored in a structured database and used as a reference for optimizing club face geometry.

At block 606, the system measures a swing characteristic of the golfer. Swing characteristics may include, but are not limited to, club head speed, attack angle, tempo, transition sequence, and/or hand path trajectory. These parameters are captured through a combination of high-speed motion tracking, inertial measurement units (IMUs), and force plate sensors. Optical tracking systems analyze the golfer's biomechanics, while depth sensors create a three-dimensional model of the swing. In some implementations, additional data may be obtained from a video recording of the golfer's swing, allowing the system to extract movement patterns and identify swing tendencies that influence club face performance.

At block 608, the process determines the optimum bulge and roll radii for the striking plate based on the golfer's swing characteristic and the data obtained from the robotic testing. A machine learning model is trained to analyze the collected data and identify the most suitable club face curvature for maximizing accuracy, distance, and forgiveness. The machine learning model correlates the golfer's biomechanical data with the impact response observed in robotic testing to generate a personalized bulge and roll recommendation. In some examples, the system extrapolates from existing data to predict performance outcomes for club face geometries that have not been physically tested, allowing for a more efficient and adaptive fitting process.

In some examples, the optimized club specifications are transmitted to a manufacturing facility for automated production. The manufacturing process includes CNC milling, laser etching, and composite material integration to precisely craft a golf club that conforms to the prescribed bulge and roll radii. If additional customization is required, the club face may incorporate a non-uniform roughness profile, where the perimeter has a higher friction coefficient than the central striking area to optimize spin control. The club head's moment of inertia and center of gravity may also be adjusted to further enhance performance characteristics tailored to the golfer's unique swing profile.

In some examples, the system determines whether additional golf clubs in the golfer's set require customized bulge and roll adjustments. In some cases, data obtained from a driver-type club may be extrapolated to determine the appropriate curvature for fairway woods, hybrids, and irons. If further adjustments are needed, the fitting process repeats for additional clubs to ensure consistency across the entire set. The system may also refine its machine learning model predictions over time by continuously integrating new data from golfers with similar swing characteristics.

In some examples, the fitted golf clubs are delivered to the golfer, and real-time feedback is collected to validate performance improvements. A robotic caddy, equipped with AI-driven decision-making capabilities, may autonomously select the appropriate golf club for each shot during play. The robotic caddy dynamically adjusts recommendations based on environmental conditions, golfer fatigue levels, and historical performance trends. By leveraging continuous monitoring and real-time analytics, the system provides an adaptive and highly personalized golfing experience, ensuring that the golfer consistently uses equipment optimized for their unique swing mechanics.

Figure 7:
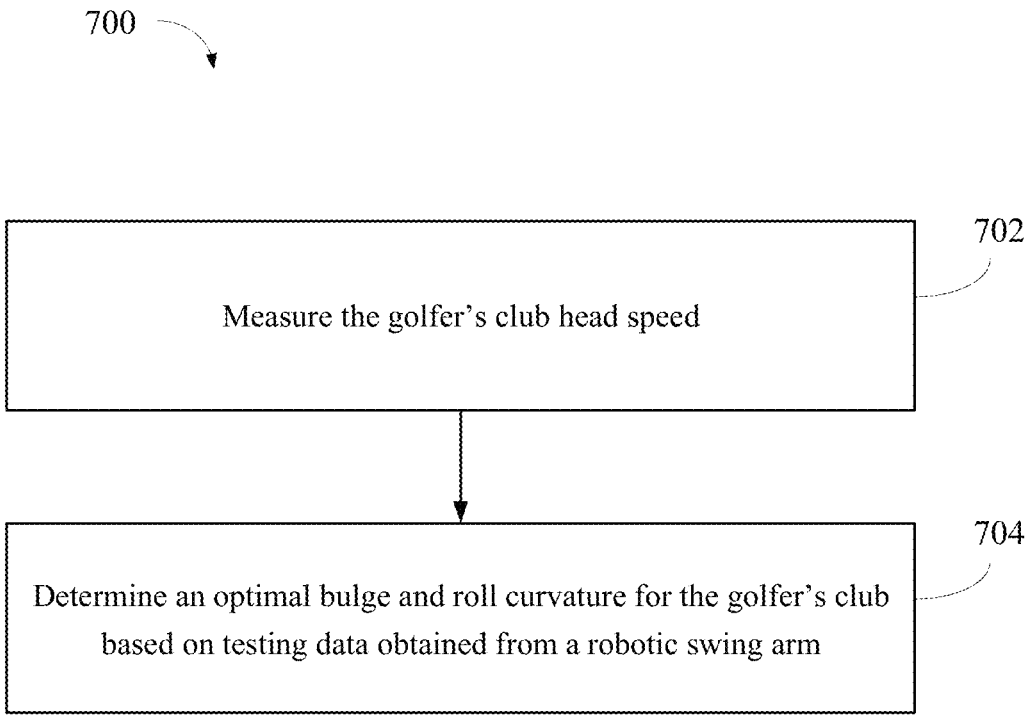
FIG. 7 is a flow diagram illustrating an example process for fitting a golfer for a set of golf clubs by determining the appropriate bulge and roll in the striking plates of the golf clubs, in accordance with various aspects of the present disclosure.

FIG. 7 is a flow diagram illustrating an example process 700 for fitting a golfer for a set of golf clubs by determining the appropriate bulge and roll in the striking plates of the golf clubs, in accordance with various aspects of the present disclosure. The process 700 begins at block 702 by measuring the golfer's club head speed. Club head speed is an example of a metric in determining optimal golf club characteristics, as it directly influences ball compression, launch dynamics, and spin rate. The golfer's club head speed may be measured using high-speed cameras, Doppler radar-based launch monitors, or optical tracking systems. In some implementations, a video recording of the golfer's swing is analyzed using motion-tracking algorithms to extract the precise velocity of the club head at impact. Inertial measurement units (IMUs) attached to the club shaft may further refine these measurements by capturing acceleration, angular velocity, and shaft deflection during the downswing.

At block 704, the process 700 determines an optimal bulge and roll curvature for the golfer's club based on testing data obtained from a robotic swing arm. The robotic system systematically tests a group of golf clubs at varying swing speeds, with each club featuring a distinct bulge and/or roll radii. The robotic swings are executed under controlled conditions, ensuring precise repeatability across different club configurations. High-speed cameras capture the ball's impact and subsequent flight path, while Doppler radar sensors measure launch conditions, including ball speed, launch angle, spin axis tilt, and shot dispersion. By analyzing how different bulge and roll curvatures influence ball trajectory at various club head speeds, the system builds a predictive model that determines the most effective curvature for a given golfer's swing profile.

In some examples, the process 700 refines the club head specifications by determining an optimum moment of inertia (MOI) value for the club head based on the golfer's swing characteristics. The MOI influences the club's resistance to twisting on off-center hits, affecting forgiveness and consistency. The system evaluates the golfer's impact tendencies—whether they frequently strike the ball toward the heel, toe, high, or low on the face—and adjusts the club head's MOI accordingly. This adjustment ensures that the club head's mass distribution optimally counterbalances the golfer's common impact patterns, improving shot accuracy and stability.

In some examples, the process 700 incorporates additional refinements to the striking plate, including the application of a non-uniform roughness profile. By altering the surface texture of the striking plate, the system can fine-tune spin characteristics, particularly on off-center strikes. For example, a smoother center region may maximize energy transfer for center strikes, while a higher-friction perimeter can enhance corrective spin on heel and toe impacts. This non-uniform roughness may be implemented through advanced manufacturing techniques such as laser etching or micro-milling, ensuring precision in surface texture application.

In some examples, once the optimal bulge and roll curvature, MOI, and surface roughness characteristics have been established, the process 700 transmits the finalized specifications to an automated manufacturing system. CNC milling machines and robotic assembly processes construct the golf club to exact tolerances, ensuring that the striking plate's curvature and texture conform to the prescribed design. Laser scanning systems perform quality control checks to verify dimensional accuracy, and any necessary final adjustments are made before club completion. If required, additional customization, such as loft and lie angle modifications, can be applied to further tailor the club to the golfer's swing characteristics.

In some examples, the fitted golf club is delivered to the golfer, and real-time validation is conducted to ensure optimal performance. The golfer may test the club in a controlled environment, such as an indoor launch monitor facility, where their swing data is reanalyzed to confirm improvements in shot consistency, accuracy, and spin optimization. Additionally, an AI-driven robotic caddy may assist in real-time club selection during gameplay, continuously analyzing swing data and environmental conditions to recommend the most suitable club for each shot. By integrating machine learning, automated manufacturing, and real-time performance tracking, the system provides a fully optimized, data-driven approach to golf club fitting and selection.

In the present disclosure, the term optimal refers to a configuration, selection, or adjustment that improves, or maximizes, performance characteristics based on predefined criteria, data-driven analysis, and empirical testing. Specifically, an optimal bulge and roll curvature, moment of inertia, or surface roughness refers to values determined through quantitative evaluation—such as robotic testing, biomechanical analysis, and machine learning predictions—to enhance key performance metrics, including shot accuracy, launch conditions, spin control, and forgiveness on off-center hits.

An optimal parameter is not limited to a single, absolute best value but rather a value that achieves the most effective performance for a given set of conditions—including the golfer's unique swing characteristics, club head speed, and impact tendencies. The determination of an optimal configuration may involve trade-offs between different performance attributes (e.g., maximizing distance while maintaining accuracy), and it may be subject to refinement based on additional data or iterative testing.

Accordingly, the term optimal may encompass a range of values that provide substantial performance benefits in view of the collected data and applied selection criteria, rather than a single, fixed value applicable in all scenarios.

Figure 8:
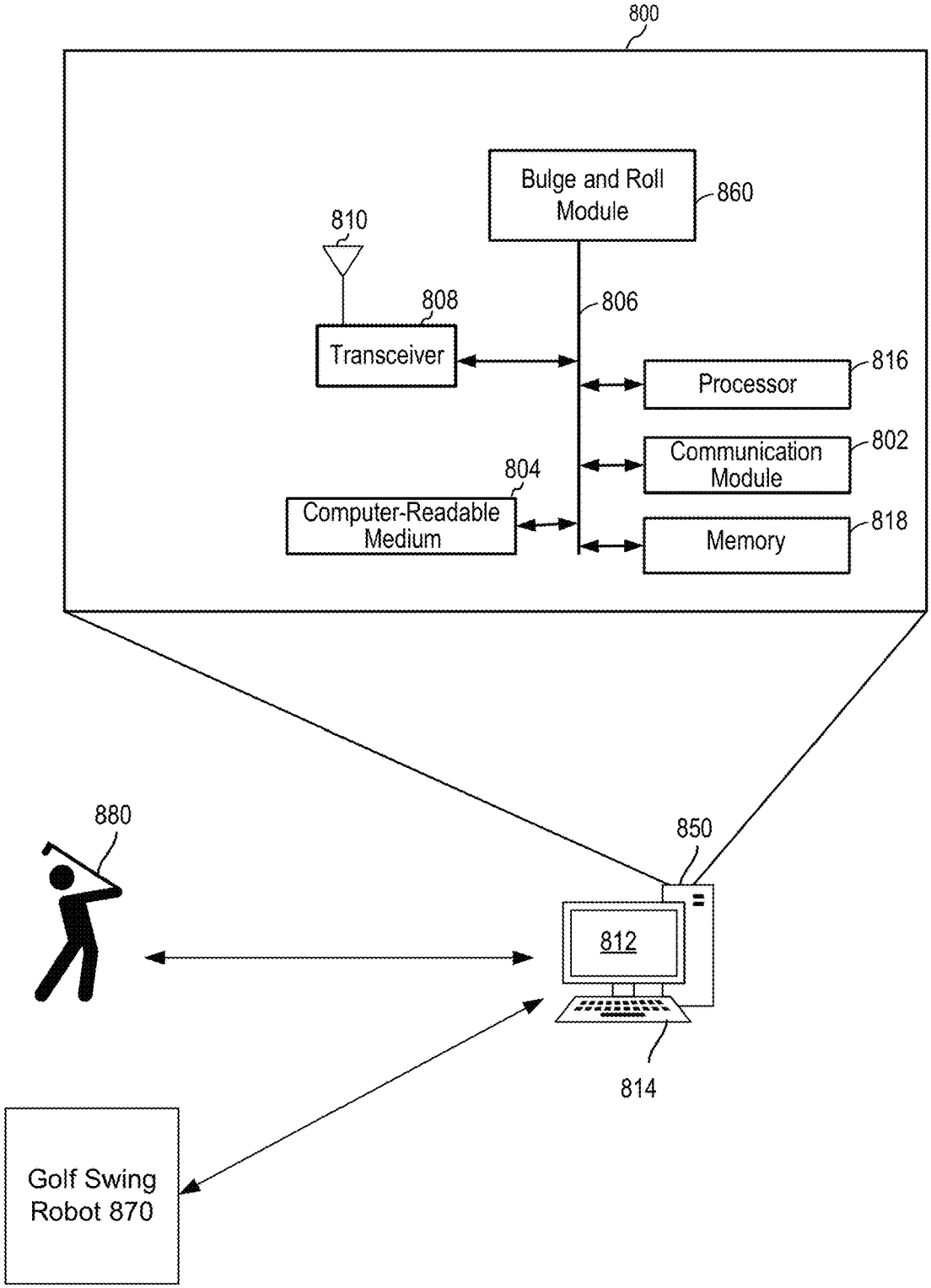
FIG. 8 is a diagram illustrating an example of a hardware implementation for a system, according to various aspects of the present disclosure.

FIG. 8 is a diagram illustrating an example of a hardware implementation for a system 800, according to various aspects of the present disclosure. The system 800 may be a component of a device 850, such as a personal computer (PC), a user equipment, a mobile device, a golf simulation device, and/or any other computing device. As shown in the example of FIG. 8, the device 850 may include a display 812 and an input device 814 (e.g., a keyboard). In some examples, the system 800 is configured to perform operations and implement one or more elements associated with one or more processes, such as the process 600 described with respect to FIG. 6 and/or the process 700 described with reference to FIG. 7.

The system 800 may be implemented with a bus architecture, represented generally by a bus 806. The bus 806 may include any number of interconnecting buses and bridges depending on the specific application of the system 800 and the overall design constraints. The bus 806 links together various circuits including one or more processors and/or hardware modules, represented by a processor 816, and a communication module 802. The bus 806 may also link various other circuits such as timing sources, peripherals, voltage regulators, and power management circuits, which are well known in the art, and therefore, will not be described any further.

The system 800 includes a transceiver 808 coupled to the processor 816, the communication module 802, and the computer-readable medium 804. The transceiver 808 is coupled to an antenna 810. The transceiver 808 communicates with various other devices over a transmission medium, such as a communication link. For example, the transceiver 808 may receive commands via transmissions from a user or a remote device.

As shown in the example of FIG. 8, the system 800 may include a bulge and roll module 860 that may be trained to facilitate a multimodal question and answer session for gather training data. For example, the bulge and roll module 860 may be trained to perform the tasks described with reference to the one or more modules, machine learning models, and/or engines. The bulge and roll module 860 may include artificial or computational intelligence elements, such as, neural network, fuzzy logic, or other machine learning algorithms. The bulge and roll module 860 may include one or more machine learning model and/or other components for implementing one or more elements associated with one or more processes, such as the process 600 described with respect to FIG. 6 and/or the process 700 described with reference to FIG. 7.

In one or more arrangements, one or more of the other modules 816, 818, 802, 804, 808, can also include artificial or computational intelligence elements, such as, neural network, fuzzy logic, or other machine learning algorithms. Further, in one or more arrangements, one or more of the modules 816, 818, 802, 804, 808 can be distributed among multiple modules 816, 818, 802, 804, 808, 860 described herein. In one or more arrangements, two or more of the modules 816, 818, 802, 804, 808, 860 of the system 800 can be combined into a single module.

The system 800 includes the processor 816 coupled to the computer-readable medium 804. The processor 816 performs processing, including the execution of software stored on the computer-readable medium 804 providing functionality according to the disclosure. The software, when executed by the processor 816, causes the system 800 to perform the various functions described for a particular device, such as any of the modules 816, 818, 802, 804, 808, 860. For example, when executed by the processor 816, the software causes the system 800 and/or the bulge and roll module 860 to implement one or more elements associated with one or more processes, such as the process 700 described with respect to FIG. 7. The computer-readable medium 804 may also be used for storing data that is manipulated by the processor 816 when executing the software. For example, working in conjunction with one or more of the other modules the modules 816, 818, 802, 804, and 808, the bulge and roll module 860 may perform one or more operations, such as the operations of the process 700 described with reference to FIG. 7.

In some examples, the device 850 may communicate with a golf swing robot 870 that is specified to test golf clubs having striking plates with various amounts of bulge and/or roll. For example, the device 850 may receive testing data from the golf swing robot via a communication interface. The testing data may then be processed by one or more of the modules 816, 818, 802, 804, 808, and 860 described with reference to FIG. 8. Additionally, or alternatively, the device 850 may communicate with a system for measuring a golf swing of a human golfer 880. The system for measuring the golf swing includes one or more sensors (e.g., devices) (not shown in the example of FIG. 8) for measuring the golfer's club head speed. Club head speed is an example of a metric in determining optimal golf club characteristics, as it directly influences ball compression, launch dynamics, and spin rate. The golfer's club head speed may be measured using high-speed cameras, Doppler radar-based launch monitors, or optical tracking systems. In some implementations, a video recording of the golfer's swing is analyzed using motion-tracking algorithms to extract the precise velocity of the club head at impact. Inertial measurement units (IMUs) attached to the club shaft may further refine these measurements by capturing acceleration, angular velocity, and shaft deflection during the downswing. The golf swing data may then be processed by one or more of the modules 816, 818, 802, 804, 808, and 860 described with reference to FIG. 8.

In some examples, the system 800 may include one or more of the modules 816, 818, 802, 804, 808, and 860 described with reference to FIG. 8. For example, the system 800 may include one or more processors 816 and one or more memories 818.

As used, the term "component" is intended to be broadly construed as hardware, firmware, and/or a combination of hardware and software. As used, a processor is implemented in hardware, firmware, and/or a combination of hardware and software.

Some aspects are described in connection with thresholds. As used, satisfying a threshold may, depending on the context, refer to a value being greater than the threshold, greater than or equal to the threshold, less than the threshold, less than or equal to the threshold, equal to the threshold, not equal to the threshold, and/or the like.

Even though particular combinations of features are recited in the claims and/or disclosed in the specification, these combinations are not intended to limit the disclosure of various aspects. In fact, many of these features may be combined in ways not specifically recited in the claims and/or disclosed in the specification. Although each dependent claim listed below may directly depend on only one claim, the disclosure of various aspects includes each dependent claim in combination with every other claim in the claim set. A phrase referring to "at least one of" a list of items refers to any combination of those items, including single members. As an example, "at least one of: a, b, or c" is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

No element, act, or instruction used should be construed as critical or essential unless explicitly described as such. Also, as used, the articles "a" and "an" are intended to include one or more items, and may be used interchangeably with "one or more." Furthermore, as used, the terms "set" and "group" are intended to include one or more items (e.g., related items, unrelated items, a combination of related and unrelated items, and/or the like), and may be used interchangeably with "one or more." Where only one item is intended, the phrase "only one" or similar language is used.

Also, as used, the terms "has," "have," "having," and/or the like are intended to be open-ended terms. Further, the phrase "based on" is intended to mean "based, at least in part, on" unless explicitly stated otherwise.

What is claimed is:

1. A method for determining a bulge and roll radii of a striking plate that is optimal for a golfer, the method comprising:

testing, via a robotic swinging arm, a plurality of golf clubs, each golf club of the plurality of golf clubs having a respective bulge radii and a respective roll radii;

gathering data obtained from the testing;

measuring a swing characteristic for the golfer; and determining an optimum bulge and roll radii to include in a striking plate based on the swing characteristic for the golfer and the data obtained from the testing.

2. The method of claim 1, wherein the swing characteristic is club head speed.

3. The method of claim 1, further comprising manufacturing a golf club with the striking plate that has the optimum bulge and roll radii for the swing characteristic.

4. The method of claim 3, wherein the golf club includes the striking plate and a body, and the striking plate is forged titanium and the body is a composite material.

5. The method of claim 1, wherein the data obtained from the testing was obtained using a driver-type club and the data is used to determine the bulge and roll radii to include in a non-driver-type club.

6. The method of claim 1, wherein measuring a swing characteristic includes data obtained from a video of the golfer swinging a golf club.

7. The method of claim 1, wherein the bulge and roll radii are not uniform across the striking plate.

8. The method of claim 7, wherein a center of the striking plate has a larger bulge and roll radii than a perimeter of the striking plate.

9. The method of claim 8, wherein the striking plate include a circular center having a uniform bulge and roll radii across the circular center.

10. The method of claim 1, further comprising determining an optimum moment of inertia value for a club head for the golfer based on the swing characteristic.

11. The method of claim 1, wherein the striking plate includes a surface having a non-uniform roughness.

12. The method of claim 11, wherein a perimeter of the striking face has a higher friction coefficient than an area proximal to the center of the striking plate.

13. The method of claim 1, further comprising receiving, at a machine learning model, the swing characteristic and the data obtained from the testing, wherein the optimum bulge and roll radii are determined via the machine learning model.

14. The method of claim 1, further comprising:

transmitting the optimum bulge and roll radii to a striking plate manufacturing machine; and autonomously manufacturing the striking plate in accordance with the optimum bulge and roll radii.

* * * * *